US005417841A

United States Patent [19]

Frisby

[11] Patent Number: 5,417,841

[45] Date of Patent: May 23, 1995

[54] COPPER PLATING OF GRAVURE ROLLS

[75] Inventor: C. Richard Frisby, Strongsville, Ohio

[73] Assignee: McGean-Rohco, Inc., Cleveland, Ohio

[21] Appl. No.: 328,612

[22] Filed: Oct. 25, 1994

Related U.S. Application Data

[63] Continuation of Ser. No. 125,596, Sep. 23, 1993, abandoned, which is a continuation of Ser. No. 562,398, Aug. 3, 1990, abandoned.

[51] Int. Cl.[6] ..... C25D 3/38

[52] U.S. Cl. ..... 205/296; 205/297; 205/298

[58] Field of Search ..... 205/296, 297, 298

[56] References Cited

U.S. PATENT DOCUMENTS

| | | | |
|---|---|---|---|
| 3,328,273 | 6/1967 | Creutz et al. | 204/52 |
| 3,542,655 | 11/1970 | Kardos et al. | 204/52 |
| 3,682,788 | 8/1972 | Kardos et al. | 204/52 R |
| 3,751,289 | 8/1973 | Arcilesi | 117/130 R |
| 3,798,138 | 3/1974 | Ostrow et al. | 204/52 R |
| 4,229,268 | 10/1980 | Lowery et al. | 204/55 R |
| 4,334,966 | 6/1982 | Beach et al. | 204/25 |
| 4,384,930 | 5/1983 | Eckles | 204/43 |
| 4,781,801 | 11/1988 | Frisby | 204/25 |
| 4,832,802 | 5/1989 | Canaris | 204/44.2 |

*Primary Examiner*—John Niebling
*Assistant Examiner*—Kishor Mayekar
*Attorney, Agent, or Firm*—Renner, Otto, Boisselle & Sklar

[57] ABSTRACT

The invention relates to a process for depositing copper on a gravure roll comprising the steps of: immersing a gravure roll in an electroplating bath comprising A) copper, B) sulfuric acid, C) at least one alkoxythio compound, D) at least one sulfonated, sulfurized hydrocarbyl compound and E) at least one grain refining thio compound, and passing electric current through the bath to deposit copper on the gravure roll.

21 Claims, No Drawings

COPPER PLATING OF GRAVURE ROLLS

This is a continuation of application Ser. No. 08/125,596 filed on Sep. 23, 1993, abandoned, which is a continuation of U.S. Ser. No. 07/562,398 filed on Aug. 3, 1990, abandoned.

FIELD OF THE INVENTION

The present invention relates to an electroplating gravure roll with a surface layer of copper. More particularly it concerns the use of a unique plating bath formulation which results in a surface coating which is ideally suited for electronic engraving.

BACKGROUND OF THE INVENTION

Gravure printing is a method of printing which uses an etched or engraved cylinder. Ink occupies the depressions in the cylinder and is transferred to a print medium. Surface defects on the cylinder, such as pits or spots which are too hard or too soft result in engraving errors and subsequent need for repolishing and replating which is expensive and time consuming.

Since the development of automatic method of electronic engraving, the electrodeposition of copper of known physical and mechanical properties with reproduceable grain size, crystal structure and hardness over the entire surface of the cylinder is desirable. The copper plating processes, typically directed towards decorative plating, have as their objective to impart leveling and brightness characteristics with little regard to precise physical properties that are important for electronic engraving. Such decorative applications are generally concerned with deposits ranging in thickness from about 0.0005 to about 0.0015 inch while gravure rolls require deposits ranging from 10 to 20 times these thickness values.

For successful electronic engraving, the copper deposits must have reproducible grain size, crystal structure and hardness. One problem associated with copper deposits involves annealing. Annealing is a tendency of the hardness of the copper deposit to decrease with time as a result of changes in crystalline size, texture, microdeformations and dislocations within the copper deposit.

Certain acid copper plating baths are also known to perform differently with respect to the immersion depth of the rotating cylinder. The principal problem in this regard is annealing. This problem of recrystallization (annealing) is characteristic of totally submerged cylinder operations when using a bath designed for partial immersion such as described by U.S. Pat. No. 4,334,966. The same holds true of partially submerged cylinder operations when using a bath designed for total immersion such as described by U.S. Pat. No. 4,781,801.

It has been discovered that by incorporating an alkoxylated compound such as alkoxylated 2-mercaptoethanol or 2,2'-thiodiethanol into the acid copper baths the problem of annealing can be eliminated at any level of immersion.

SUMMARY OF THE INVENTION

The invention relates to a process for depositing copper on a gravure roll comprising the steps of:

immersing a gravure roll in an electroplating bath comprising a) copper, b) sulfuric acid, c) at least one alkoxythio compound, d) at least one sulfonated, sulfurized hydrocarbyl compound and e) at least one grain refining thio compound, and passing electric current through the bath to deposit copper on the gravure roll.

In another aspect, the instant invention relates to the above electroplating bath composition adapted for electrodepositing a gravure roll with a layer of copper which is especially suited for electronic engraving.

The present method and composition produce copper coatings which have consistent hardness on storage, i.e., minimal, if any, annealing. The plating may be accomplished by partial or complete immersion of the cylinder in the bath. The invention also provides a means to control the hardness and brittleness of copper layers on gravure rolls. The present method also controls treeing or excessive copper deposition at the high current ends of the gravure cylinder.

DESCRIPTION OF THE PREFERRED EMBODIMENTS

It is necessary to maintain a balance of certain additives which function together in order to provide a deposit that is (1) free of treeing, (2) has a uniform crystal structure with the desired hardness throughout the thickness and length of the deposit, and (3) does not anneal.

According to the present invention, the combination of additives found to achieve this goal is dependent upon the use of a specific class of compounds selected to suppress annealing while preserving other desirable qualities of the deposit.

The electroplating bath of the present invention includes copper, preferably copper ions in the form of copper sulfate. Copper sulfate is preferably present in the form copper sulfate pentahydrate. Generally from about 150 to about 225 grams per liter, preferably 200 to 210 of copper sulfate pentahydrate is included in the bath of the present invention.

Sulfuric acid is included in the bath of the present invention. It is present in an amount from about 35 to about 90 grams per liter, preferably 50 to 60.

The grain refining thio compound contains a structural unit represented by one of the formulae:

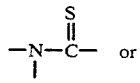

(I)

or

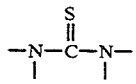

(II)

Examples of thio compounds include thiocarbamates (I), including dithiocarbamates and their derivatives, and thioureas (II) and their derivatives. Specific examples include 2-imidazolidinethione (MW 102.17), 1,1'-thiocarbonyldiimidazole (MW 178.22), or 2-thiohydantoin (MW 116.14). The grain refining thio compound is generally present in an amount from about 0.5 to about 5.0 mg/l.

The alkoxythio compounds are represented by the formula $$H(OR)_nS(RO)_nH \quad \text{(III)}$$

or $R_1—S(RO)_nH$ (IV)

wherein n is an average number of 1 to about 20, preferably 6 to about 12, preferably about 7 to about 11, more preferably about 9, R is an alkylene group having from 1 to about 8, preferably 2 to about 4 carbon atoms, and $R_1$ is hydrogen or an alkyl group having from 1 to about 12 carbon atoms, preferably 1 to about 6. R is preferably an ethylene, propylene or butylene group, preferably an ethylene group. $R_1$ is preferably hydrogen or a methyl, ethyl, propyl or butyl group. Preferably, the alkoxythio compound is represented by formula (III). These materials are generally known as alkoxylated thiols, preferably alkoxylated thiodiglycols, more preferably ethoxylated thiodiglycols. An Example of an ethoxylated thiodiglycol is Pegol TDG-1250 which is available commercially from Rhone-Poulenc Inc. of Princeton, N.J. The alkoxythio compounds are generally present in an amount from 0.01 to about 1.0 gram per liter, preferably 0.05 to 0.1.

Component (d) of the present invention is at least one sulfonated, sulfurized hydrocarbyl compound. Preferably, the hydrocarbyl compound is an aromatic or aliphatic hydrocarbon, preferably an aromatic hydrocarbon. Examples of aromatic hydrocarbons include benzenes, including alkyl benzenes, phenols and aromatic amines, preferably benzenes. The hydrocarbyl compounds are sulfurized by the use of sulfur chloride, sulfuryl chloride or thionyl chloride as the sulfurizing agents. Elemental sulfur and alkali metal sulfides or mixtures thereof may also be used. Alternatively, commercially available thio-aromatic compounds, such as thioanthracene, diphenol sulfide, diphenol disulfide, thiophenol and the like may be used to form the sulfonated sulfurized hydrocarbyl compounds.

The sulfurized hydrocarbyl compounds are then sulfonated according to well known procedures using fuming sulfuric acid, sulfur trioxide or chlorosulfuric acid to form brightening agents of the present invention. Sulfonation may also occur prior to sulfurization of the hydrocarbyl compounds.

The sulfonated sulfurized hydrocarbyl compounds as well as methods for preparing the same are similar to those disclosed in U.S. Pat. No. 2,424,887 issued to Hendricks, the disclosure of which is incorporated by reference for the purpose of describing the above compounds and process of making the same. Generally, the sulfonated, sulfurized hydrocarbyl compound is present in the plating bath in an amount from about 1 mg/l to about 100 mg/l, preferably about 10 to about 40, more preferably about 15 to about 25.

Generally, the bath should contain from about 20 to about 80 ppm chloride ion, preferably about 40 to about 60 ppm, more preferably 50 ppm. The chloride ion is added as hydrochloric acid.

The plating is applied to the roll in a plating bath with a temperature ranging from about 70° F. to about 120° F., preferably from about 75° F. to about 90° F. Higher temperatures may be employed but at the expense of greater cost due to the increased concentration and consumption of additives necessary to produce the desired result. In order to achieve high deposition rates and develop a uniform deposit, the roll is normally rotated on its axis to develop a surface feed of about 300 feet per minute (SF/min). The current may be from about 60 to about 480 amperes (AMPS) per square foot of roll surface, preferably from about 100 to about 250, more preferably about 100 to about 200. Plating is continued until the deposit is at least about 0.005 to about 0.020 inches, preferably about 0.010 to about 0.020. The deposit typically has a Rockwell T hardness of about 91 to about 92 as plated with no loss after standing at room temperature for a prolonged period of time. Ductility of the deposit is determined on the foil by flexing it 180°. Ductile foil will fold whereas a brittle foil will break.

Furthermore, the copper deposit is improved upon for the purpose of this gravure application by substituting this discovered compound in place of the typical polyether surfactants as noted in the following examples.

REFERENCE EXAMPLE A

A plating bath is prepared by adding 210 g/l of copper sulfate pentahydrate, 60 g/l of sulfuric acid, 50 ppm of chloride added as hydrochloric acid, 20 mg/l of sulfurized benzene sulfonate and 80 mg/l of polyether surfactant (Pluracol P-710) to a vessel. A gravure roll six inches long and two inches in diameter is plated completely submerged in the bath at 80° F. at a current density of 150 AMPS/sq. ft. while being rotated at 300 SF/min. to produce a copper deposit, 0.005 inch thick, which has a Vickers hardness of 168. The deposit of copper obtained has a grainy matte surface with a semi-bright appearance in the extreme high current density areas. The copper deposit is removed from the cylinder as a Ballard foil and a sample of the deposit anneals to a Vickers hardness of 136 when it is subjected to an accelerated annealing test by heating the sample to 100° C. for 1 hour in an oven.

Example I of the Invention

The bath of Reference Example A is modified by replacing the polyether surfactant (Pluracol P-710) with 40 mg/l of Pegol TDG-1250, an ethoxylated 2,2'-thiodiethanol, and a gravure roll was plated using the same parameters. The deposit of copper so obtained has a uniform semi-bright appearance and an as plated hardness of 200 Vickers. A sample of the deposit does not anneal when it was subjected to the heretofore described accelerated annealing test.

Example II of the Invention

A gravure roll is plated in the bath of Example I at the same parameters except the level of immersion is 30%. The deposit of copper obtained has a uniform semi-bright appearance and an as plated hardness of 198 Vickers. A sample of the deposit does not anneal when it is subjected to the accelerated annealing test.

Example III of the Invention

The bath of Example I is modified by the addition of 3 mg/l of 2-imidazolidinethione and a gravure roll is plated using the same parameters. The deposit of copper obtained has a uniform bright appearance and an as plated hardness of 225 Vickers. A sample of the deposit does not anneal when it is subjected to the accelerated annealing test.

Example IV of the Invention

A gravure roll is plated, in the bath of Example III at the same parameters except that the level of immersion is 30%. The deposit of copper obtained has a uniform bright appearance and an as plated hardness of 220 Vickers. A sample of the deposit does not anneal when it is subjected to the accelerated annealing test.

Example V of the Invention

A plating bath is prepared containing 210 g/l of copper sulfate pentahydrate, 60 g/l of sulfuric acid and 50 ppm of chloride added as hydrochloric acid. A first premixed make-up aqueous additive package (A) is formulated to contain 2.5 g/l of the sulfurized benzene sulfonate and 10 g/l of Pegol TDG-1250. Premix concentrate (A) is then added to the above-described bath to give a concentration of 0.4% of premix concentrate (A) in the bath. A second premix aqueous concentrate (B) is formulated to contain 5 g/l of the sulfurized benzene sulfonate, 20 g/l of Pegol TDG-1250 and 1.68 g/l of 2-imidazolidinethione of which is added to the bath in an amount sufficient to give a 0.2% concentration of premix concentrate (B) in the bath. A gravure roll is plated 50% submerged at 85° F. at 200 AMPS/sq. ft. while being rotated at 300 SF/min. to produce a deposit, 0.020 of an inch thick with a Vickers hardness of 220. The deposit on the cylinder demonstrates good engravability by the electronic method. The deposit hardness does not change from the as-plated values for the presently monitored 5 months.

It should be noted that the bath of Example V has been tested under commercial conditions. The bath has been operated continuously as a two shift operation with weekend shutdown periods of one to two days. Over a current density range of 1 to 2 AMPS/sq. in. and a temperature range of 75° to 105° F. at various levels of cylinder submersions, including 25%, 50%, 75% and 100% immersion, the bath has produced copper deposits for electronic engraving that do not anneal.

A further advantage to the combined use of the prescribed additives is the ability to adjust the internal stress properties of the copper deposit. The capability of providing a copper deposit of desired stress is a significant advantage in gravure operations employing the Ballard Process where the copper foil is removed from the cylinder, as well as in other electro-forming applications. The stress values of the following examples were determined using the Brenner-Senderoff contractometer.

Example VI of the Invention

A plating bath is prepared containing 210 g/l of copper sulfate pentahydrate, 60 g/l of sulfuric acid and 50 ppm of chloride added as hydrochloric acid. A stress value of 3208 psi tensile is determined for this stock solution.

Example VII of the Invention

The bath of Example VI is modified by the addition of 20 mg/l of sulfurized benzene sulfonate and a stress value of 5945 psi compressive is obtained.

Example VIII of the Invention

The bath of Example VII is modified by the addition of 20 mg/l of Pegol TDG-1250 and a zero stress value is obtained.

Example IX of the Invention

The bath of Example VIII is modified by the addition of 3 mg/l of 2-imidazolidinethione and a stress value of 1282 psi tensile is obtained.

Another advantage to the combined use of the prescribed additives is the ability to control the operating bath by Hull Cell analysis as indicated in the following table. Generally the bath is controlled by taking a sample from a plating bath and adding the sample to a Hull Cell; forming a deposit on a panel in the Hull Cell; determining the roughness or brightness of the deposit on the panel; and adding a mixture of an alkoxythio compound (C) and a sulfonated, sulfurized hydrocarbyl compound (D), or a mixture of (C), (D) and a grain refining thio compound (E). The roughness or brightness is determined by comparison to a control panel or a brightness range. The control panel and brightness range depends on the application and the determining of the range would be known to a person skilled in the art.

| Panel | 1-1 | 1-2 | 2-1 | Example V |
|---|---|---|---|---|
| $CuSO_45H_2O$<br>$H_2SO_4$<br>HCl | 210 g/l<br>60 g/l<br>51 ppm | | 210 g/l<br>60 g/l<br>51 ppm | See Ex. V for details of composition used |
| Premix A (See Ex. V) | | 0.4% W | | |
| Premix B (See Ex. V) | | | 0.2% W | |
| Results | smooth satin | semi-bright HCD to MCD dull MCD to LCD | bright rough HCD/ Haze | smooth HCD bright to LCD |

HCD = High Current Density
MCD = Mid Current Density
LCD = Low Current Density

As can be seen from the above data, control of plating bath may occur by adding Premix A or Premix B. Premix A controls roughness of the panel deposit and Premix B controls brightness. By examining the panel produced from the Hull cell and using brightness and/or roughness specifications, an operator may control the plating by adding quantities of Premix A or Premix B. For instance, if the panel has roughness at the high current density, an operator may add Premix A to the bath. An operator may be human or mechanical, such as pumps controlled by a computer.

I claim:

1. A process for depositing a layer of copper on a gravure roll comprising the steps of partially or completely immersing the gravure roll in an electroplating bath consisting essentially of copper ions, chloride ions, sulfuric acid, an alkoxythio compound, a sulfonated, sulfurized hydrocarbyl compound, and passing electric current through the bath to deposit a copper layer on the gravure roll.

2. The process according to claim 1 wherein the copper ions are in the form of copper sulfate.

3. The process of claim 1 wherein the alkoxythio compound represented by one of the formulae $$H(OR)_nS(RO)_nH \quad \text{(III)}$$

or $$R_1S(RO)_nH \quad \text{(IV)}$$

wherein R is an alkylene group having from 1 to about 8 carbon atoms, each n is independently an average number from 1 to about 20, and $R_1$ is an alkyl group having from 1 to about 12 carbon atoms.

4. The process of claim 3 wherein each n is independently an average number from about 7 to about 11, R has from 2 to about 4 carbon atoms, and $R_1$ has from 1 to about 6 carbon atoms.

5. The process of claim 3 wherein the alkoxythio compound is represented by formula (III).

6. The process of claim 5 wherein n is from about 7 to about 11 and R has from 2 to about 4 carbon atoms.

7. The process of claim 1 wherein the alkoxythio compound is an ethoxylated thiodiglycol.

8. The process of claim 1 wherein the chloride ion is present from about 20 to about 80 ppm.

9. The process of claim 1 wherein the electric current is from about 60 to about 450 AMPS per square feet.

10. The process of claim 1 wherein the sulfuric acid is present from about 35 to about 90 g/l, the alkoxythio compound is present from about 0.01 to about 1.0 g/l, and the sulfonated, sulfurized hydrocarbyl compound is present from about 1 to about 100 mg/l.

11. A method of controlling annealing in electrodeposited copper layers on gravure rolls comprising depositing the copper from an electroplating bath consisting essentially of copper ions, chloride ions, sulfuric acid, an alkoxythio compound and a sulfonated, sulfurized hydrocarbyl compound on the gravure roll.

12. A process for depositing a layer of copper on a gravure roll comprising the steps of partially or completely immersing the gravure roll in an electroplating bath comprising copper ions, chloride ions, sulfuric acid, at least one alkoxythio compound and at least one sulfonated, sulfurized hydrocarbyl compound, wherein the electroplating bath is free of grain refining compounds having the structural unit represented by one of the formulae

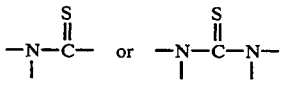

and passing electric current through the bath to deposit a copper layer on the gravure roll.

13. An electroplating bath, consisting essentially of copper ions, chloride ion, sulfuric acid, an alkoxythio compound, and a sulfonated, sulfurized hydrocarbyl compound.

14. The bath of claim 13 wherein the copper ions are in the form of copper sulfate.

15. The bath of claim 13 wherein the alkoxythio compound represented by one of the formulae $$H(OR)_nS(RO)_nH \quad \text{(III)}$$

or $$R_1S(RO)_nH \quad \text{(IV)}$$

wherein R is an alkylene group having from 1 to about 8 carbon atoms, each n is independently an average number from 1 to about 20, and $R_1$ is an alkyl group having from 1 to about 12 carbon atoms.

16. The bath of claim 15 wherein each n is independently an average number from about 7 to about 11, R has from 2 to about 4 carbon atoms, and $R_1$ has from 1 to about 6 carbon atoms.

17. The bath of claim 15 wherein the alkoxythio compound is represented by formula (III).

18. The bath of claim 17 wherein n is from about 7 to about 11 and R has from 2 to about 4 carbon atoms.

19. The bath of claim 13 wherein the alkoxythio compound is an ethoxylated thiodiglycol.

20. The bath of claim 13 wherein the sulfuric acid is present from about 35 to about 90 g/l, the alkoxythio compound is present from about 0.01 to about 1.0 g/l, and the sulfonated, sulfurized hydrocarbyl compound is present from about 1 to about 100 mg/l.

21. A method of controlling hardness and brittleness of copper deposits on a gravure roll comprising the steps of:

(i) taking a sample from a plating bath consisting essentially of copper ions, chloride ions, sulfuric acid, at least one alkoxythio compound, and at least one sulfonated, sulfurized hydrocarbyl compound and adding the sample to a Hull Cell;

(ii) forming a deposit on a panel in a Hull Cell;

(iii) determining roughness or brightness of the deposit on the panel;

(iv) adding to the bath an amount sufficient to improve the roughness or brightness of the deposit of at least one mixture of (C) an alkoxythio compound and (D) a sulfonated, sulfurized hydrocarbyl compound.

* * * * *